United States Patent [19]

Yasui et al.

[11] Patent Number: 4,778,741

[45] Date of Patent: Oct. 18, 1988

[54] PHOTORECEPTOR FOR ELECTROPHOTOGRAPHY

[75] Inventors: Masaru Yasui, Yokohama; Kazuhisa Kato, Atsugi; Fumiyuki Suda, Yokohama, all of Japan

[73] Assignee: Stanley Electric Co., Ltd., Tokyo, Japan

[21] Appl. No.: 39,795

[22] Filed: Apr. 15, 1987

Related U.S. Application Data

[63] Continuation of Ser. No. 752,928, Jul. 8, 1985, abandoned.

[30] Foreign Application Priority Data

Jul. 11, 1984 [JP] Japan ..... 59-144032

[51] Int. Cl.[4] ..... G03G 15/04

[52] U.S. Cl. ..... 430/66; 430/57; 430/67

[58] Field of Search ..... 430/57, 66, 67

[56] References Cited

U.S. PATENT DOCUMENTS

| | | | |
|---|---|---|---|
| 4,414,319 | 11/1983 | Shirai et al. | 430/66 X |
| 4,490,453 | 12/1984 | Shirai et al. | 427/74 X |
| 4,539,283 | 9/1985 | Shirai et al. | 430/67 X |
| 4,544,617 | 10/1985 | Mort et al. | 430/67 X |
| 4,555,464 | 11/1985 | Kido et al. | 430/67 |

FOREIGN PATENT DOCUMENTS

| | | | |
|---|---|---|---|
| 3420741 | 12/1984 | Fed. Rep. of Germany | 430/67 |

*Primary Examiner*—Roland E. Martin

*Attorney, Agent, or Firm*—Spensley Horn Jubas & Lubitz

[57] ABSTRACT

An amorphous silicon photoreceptor for electrophotography having a surface protective layer provided on top of an amorphous silicon photoreceptive layer and has a forbidden band width arranged to progressively increase as it goes from the surface of the photoreceptive layer toward the surface of the surface protective layer. A p type amorphous silicon layer may be provided between the amorphous silicon photoreceptive layer and the surface protective layer.

11 Claims, 2 Drawing Sheets

PHOTORECEPTOR FOR ELECTROPHOTOGRAPHY

This a continuation of copending application Ser. No. 752,928 filed on July 8, 1985, abandoned.

BACKGROUND OF THE INVENTION (a) Field of the Invention

The present invention relates to a photoreceptor for electrophotography, and more particularly it pertains to a protective film made of amorphous silicon for photoreceptors intended for electrophotography.

(b) Description of the Prior Art

It was reported by Spear in 1976 that amorphous silicon (non-crystalline silicon, hereafter to be called briefly a-Si) which was obtained by processing silane ($SiH_4$) gas by relying on the plasma CVD (Chemical Vapor Deposition) technique became a useful semiconductor material which permitted the control of the conductivity type and carrier density of the film owing to the fact that those hydrogen atoms which were taken therein were coupled with Si dangling bonds reduced local electron trapping level of the film (Applied Physics Letter, vol. 28, No. 2, January 1976).

Due also to subsequent laboratorial studies which have made it clear that a-Si allows the acquisition of a large-size film at a low cost, a-Si is now becoming a material indispensable for the manufacture of semiconductor devices such as solar battery and thin-film transistor. And, owing to the fact that this a-Si film possesses superior properties such as freedom from pollution, high resistivity and long service life, there has been considered the application of this film to a photoreceptor for electrophotography. However, since those a-Si films which were obtained in their earlier stage of development showed resistance values not high enough for satisfying the requirements of photoreceptors, there has been a delay in putting a-Si films to practical photoreceptors for electrophotography. This delay is considered to be due to the reason that a photoreceptor is of such a physical property that, when a photoreceptor not having a high resistivity is charged with electricity at the surface of the a-Si film by the application of a corona discharge, the photoreceptor exhibits an intensive voltage decay in darkness, leading to a poor charge holdability. In order to compensate for this drawback, consideration was given to the elevation of the resistivity of photoreceptors by, for example, forming a pn junction in the vicinity of the surface layer of the a-Si film by utilizing the controllability of the conductivity type of the layer. This consideration, however, has not been put to practice yet due to various problems and difficulties.

The present inventors attempted to improve the electric charge preservability of the film by elevating the resistivity of the a-Si film per se, and have succeeded in obtaining an a-Si photoreceptor having such a high resistivity as is comparable to that of an Se photoreceptor, and disclosed this success in Japanese Patent Preliminary Publication No. Sho 57-37352. This publication shows the art that an a-Si film is obtained by relying on the CVD technique while mixing an appropriate volume of $N_2$ gas and $B_2H_6$ gas into silane ($SiH_4$) gas. The a-Si film thus obtained exhibited a markedly high resistivity and also a good photoreceptivity, and in reality an excellent image could be formed. From the practical point of view, however, the above-mentioned a-Si film was not necessarily satisfactory with respect to its service life. The reason therefor was considered to be found in the following. That is, within the apparaus such as a copying machine or a printer, the surface of a photoreceptor is subjected to various stimuli. These stimuli include chemical reactions due to adsorption of ozone and nitrides produced by corona discharge and also due to the deposition of chemically active substances produced by these adsorbed substances and the moisture existing in the air and toners; and also include physical reactions due to abrasion caused by the cleaning plate or due to friction against a paper sheet, and the deposition and diffusion of Na due to finger-touch occurring during the handling operation. These stimuli would more-or-less adversely affect the quality of the image which is to be obtained, and in case these stimuli lasted for an extended period of time, they would bring forth, for example, a marked degradation of the quality of the image as represented by white striations, white spot-like local losses of image, blurring of image and development of fog.

The inventors, therefore, have earlier proposed a method of forming an amorphous silicon nitride (a-$Si_xN_{1-x}$) film continuously on an a-Si film as a means of protecting the underlying a-Si film by relying on the same starting gases and using the same apparatus as those employed in the manufacture of a-Si photoreceptor layer, but changing only the operating conditions such as the gas flow rate and the value of the electric power supplied. This proposal is disclosed in Japanese Patent Preliminary Publication No. Sho 58-145951. By the formation of this surface protective layer, the a-Si photoreceptor did reach the stage of practical use with respect to items of both the image formation and the service life. At present, this surface protective layer is not limited to amorphous silicon nitride alone, but study is being made of such films as amorphous silicon oxide and amorphous silicon carbide.

The relationship between the above said surface protective layer and the property of the photoreceptor will be discussed further with respect to the device having a conventional structure by giving reference to FIGS. 1A to 1D. In FIG. 1A, there is formed, on a conductive substrate 1 such as aluminum to a thickness of $1 \sim 5$ μm, an a-Si photoreceptive layer 2 containing hydrogen atoms, made by decomposing $SiH_4$ gas mixed with $N_2$ gas, $B_2H_6$ gas or $PH_3$ gas in some cases, by relying on the plasma CVD technique. This a-Si film 2 possesses such a high resistivity as $10^{12}$ Ω.cm or higher. Upon this a-Si photoreceptive layer 2, there is formed continuously to a thickness of $0.01 \sim 1$ μm an insulator layer 3 having a forbidden band width greater than that of the a-Si photoreceptive layer. The energy band structure of this a-Si photoreceptor of FIG. 1A in its equilibrium state prior to actual photographing operation is shown in FIG. 1B. Also, the energy band structure thereof when the surface of the photoreceptor is charged positive by corona discharge is shown in FIG. 1C. Here, symbol $E_F$ represents Fermi level, $E_V$ the top of the valence electron band, and $E_C$ the bottom of the conduction band. FIG. 1D shows the state that carriers are produced when an image light beam has impinged onto the film. Owing to this incident light, there is produced electronpositive hole pairs within the photoreceptive layer, and electrons flow toward the surface side thereof, while positive holes flow toward the substrate 1 side thereof to thereby neutralize the electric charges of the substrate and the surface, respectively. In case there is provided an insulator layer 3 at the surface, electrons will move, and if they pass through the insulator layer 3 due to the tunnel effect and reach the surface, they can neutralize the surface electric charge. However, if the insulator layer is too thick for electrons to cross over the barrier of the insulator layer, they are trapped at the interface between the a-Si layer 2 and the insulator layer 3, and thus the level of the residual potential is determined by the surface charge which has not been neutralized.

In the earlier period of development of art of this field, the insulator layer was considered to be important of its nature as a surface protective layer of photoreceptors. However, in the stage of art wherein it was not possible to obtain an a-Si film having a high resistivity, the role of the insulator layer as a blocking layer was important also for blocking the phenomenon that the surface charge become neutralized by both the travel and the injection of carriers from the photoreceptive layer. For this reason, if the surface insulator layer is formed to a substantial thickness, there will not be developed a tunnel for carriers, resulting in that the residual potential becomes very high, so that there is formed a space charge region in the vicinity of the interface between the photoreceptive layer 2 and the insulator layer 3, which region serving to further block the moving of carriers. Therefore, the thickness of the insulator layer has to be very small such as several tens of Ångstrom, less than 1000Å at the most. Therefore, when considered from the viewpoint of the surface protecting function, it as not possible to secure a long service life. Conversely, in case the insulator layer is given a sufficient thickness, it is not longer possible to rely on Carlson method, and there is such a problem that one has to consider an altogether different copying system such as the NP method.

SUMMARY OF THE INVENTION

It is, therefore, the principal object of the present invention to provide a photoreceptor for electrophotography having an insulating and protecting layer comprised of amorphous silicon nitride having both a structure and a composition capable of stably protecting the photoreceptive layer even after a use of an extended period of time without giving rise to a degradation of the quality of the image obtained.

The photoreceptor for electrophotography according to the present invention which is an amorphous silicon photoreceptor having a surface protective layer formed on an amorphous silicon photoreceptive layer features the arrangement that the forbidden band width of the surface protective layer increases progressively toward the outside of the photoreceptor from the surface of the photoreceptive layer. More particularly, this photoreceptor features the structure that the abovesaid surface protective layer is comprised of an amophous silicon nitride film and its composition ratio Si/N progressively decreases as it goes toward the outside from the surface of the photoreceptive layer.

According to the present invention, it is possible to sufficiently increase the resistivity of the amorphous silicon photoreceptive layer. Accordingly, even when there is formed a surface insulating layer having a relatively great thickness such as $0.01 \sim 1$ μm and even when there is thus produced a slight residual potential, it is possible to secure a sufficient ratio relative to the total, i.e. sufficient S/N ratio can be secured. as a result, the aim of surface protection under Carlson method can be attained, and at the same time therewith, elongation of service life can be realized.

This and other objects of the present invention will become more apparent during the course of the following description and appended claims.

DETAILED DESCRIPTION OF THE PREFERRED EMBODIMENTS

Figure 1A:
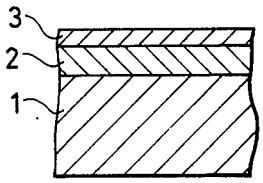
FIG. 1A PRIOR ART
FIG. 1A is a diagrammatic sectional view of a conventional a-Si photoreceptor.

The present invention will hereunder be described in further detail with respect to various experiments conducted.

When an amorphous silicon nitride ($Si_xN_{1-x}$) is considered as a surface protective film material, the most suitable and stable film both chemically and structually is considered to be $Si_3N_4$ of stoichiometric composition. It is, however, difficult to obtain a perfect $Si_3N_4$ composition merely by relying on the plasma CVD technique. It is usual that $Si_3N_4$ contains hydrogen and that its Si/N ratio is in the range of $0.8 \sim 1.5$ which is somewhat excessive in the amount of Si as compared to the stoichiometric composition ratio of Si/N $=0.75$. In order to make this composition closer to perfect $Si_3N_4$ as much as possible, it is necessary to elevate the nitrogen gas-to-silane gas ratio as well as the radio frequency power and also to elevate the substrate temperature as high as possible. By doing so, it becomes possible to obtain a film having a composition close to $Si_3N_4$.

Therefore, by first mixing appropriate volumes of $SiH_4$ gas, $N_2$ gas and $B_2H_6$ gas together, and after forming an a-Si layer to a certain thickness on a substrate under certain conditions, an amorphous silicon nitride film was formed further on top of said a-Si layer to a certain thickness by altering the producing conditions. The assembly thus formed was examined of its copying function, with the below-mentioned result.

Experiment (A)

First, an amorphous silicon nitride $Si_xN_{1-x}$having a composition as much closer as possible to $Si_3N_4$ was formed. It had a surface protective layer of a thickness of 1500Å. The film thus formed had a composition ratio of Si/N=0.8, a resistivity of $10^{15}$ Ω.cm, and $E_0=5$eV. This film was used for a photoreceptor, and copies were taken using this film. It was found that the first sheet of copy presented a clear image. However, the second and onward sheets of copy were noted to be such that the images began to be markedly blurred, and that the severalth and onward copies were practically hardly acceptable. This photoreceptor was then charged with electricity of the opposite polarity to make the surface potential zero, and again copying operations were performed. It was noted that the second and subsequent copies presented phenomena similar to those mentioned above. After all, it was found that, in spite of the fact that the role as a surface protective layer could be fulfilled, it was not possible to successively obtain high-quality copies of an image.

Experiment (B)

Next, an amorphous silicon nitride film having a composition shifted further from $Si_3N_4$ was formed to the same thickness of 1500Å as in Experiment (A) while altering the gas flow rate and the radio frequency power. This film showed that its composition ratio was Si/N=1.2, a resistivity of $2\times10^{14}$ Ω.cm, and $E_0$=3-.8eV. The copying function of this film was such that a clear image was obtained beginning with the first copy, and no particular problem occurred for the successive copying. However, when endurance test was repeated intermittenly, white striations and unevenness of image appearance became prominent on copies of around 20,000th and onwards, so that this film was not noted to be perfect yet with respect to the length of service life.

From the results of Experiments (A) and (B), it was noted that the closer to $Si_3H_4$ the composition was which would give a stable protective film, the more the required property of a photoreceptor was impaired. The cause therefor was probed while conducting other experiments, and the cause was concluded to lie in the following.

Figure 1B:
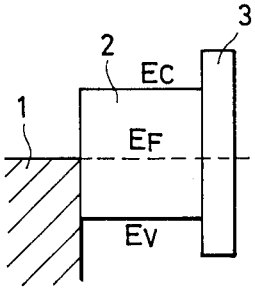
FIG. 1B PRIOR ART
FIG. 1B, 1C and 1D are illustrations showing the energy band structures in the a-Si photoreceptor shown in FIG. 1A.
Figure 1C:
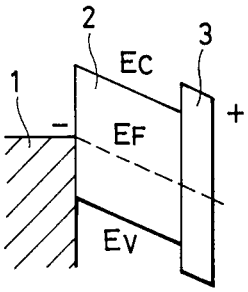
FIG. 1C PRIOR ART
Figure 1D:
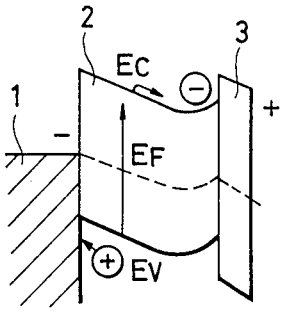
FIG. 1D PRIOR ART

An a-Si layer serving as a photoreceptor has a forbidden band width of 1.7~1.9eV, as contrasted by the forbidden band width of amorphous silicon nitride film which is greater than said width of the a-Si layer. Accordingly, by forming this amorphous silicon nitride film as a protective layer on the surface of the photorecetptive receptive layer, there can be formed a barrier at the interface as shown in FIGS. 1A to 1C. Therefore, when those carriers which are produced in the photoreceptive layer move and arrive in the vicinity of the surface, it will be understood that, in order that these carriers tunnel through the insulator layer to neutralize the surface charge, the height and the width of this barrier require to have such values as are not greater than certain values. In case the carriers have a difficulty in passing through the insulator layer quickly, they will be accumulated at the interface between the photoreceptive layer and the protective layer as a result of repetitive irradiation of the incident light. Therefore, there is formed such a space charge region as shown in FIG. 1D. This region serves to bend the energy band, and this bent band will form a new barrier to further block the carriers which are moving toward the surface, thereby bringing about an elevation of the residual potential, the lowerign of the photosensitivity as well as the lowering of the charge potential. Not only that, there will be formed a conducting channel in the direction parallel with the surface by those carriers which have been accumulated in the vicinity of the interface, making it easy for the carriers to scatter. Also, when the image is transferred and charge with electricity, i.e. when the film is charged in the pattern corresponding to the image, the carriers are scattered so that there will also develop a coupling of charges via the insulator layer, with the result that the dissolving power will drop, causing a blurred image to appear.

Figure 2A:
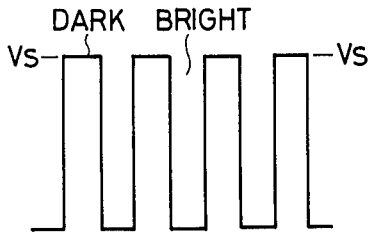
FIG. 2A is an illustration of waveshape to explain the charging property, the resolving power and the residual potential of the a-Si photoreceptor according to the present invention.
Figure 2B:
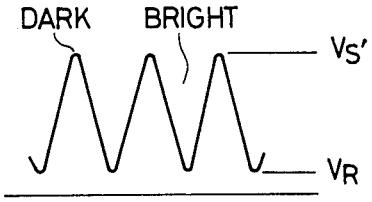
FIG. 2B PRIOR ART
FIG. 2B is an illustration of waveshape for explaining the charging property, the resolving power and the residual potential of a conventional photoreceptor.

It has been found that, in view of the foregoing things, if it is possible to charge the entire surface of the photoreceptor with an even potential $V_S$ and to arrange so that, when said even potential is split into bright areas and dark areas by a certain space frequency, the potential will exert a sharp change as shown in FIG. 2A, and that this will provide an excellent resolving power which will serve to avoid the blurring of image taken. In case, however, the surface protective layer is not adequate, the change between bright and dark will take a moderate pattern as shown in FIG. 2B, leading to a degraded resolving power and giving rise to the development of a residual potential, causing blurring of image.

As such, in case the protective layer having the composition employed in Experiment (A) is used, it will be needed to rely on a method intended to neutralize the space charge for every photographing operation; for example there will be needed a charging of opposite polarity or an alternate current charging or simultaneous application of both reverse-sign voltages through exposure to light. In such a case, the precision control of electrophotographing apparatus conditions also will become complicated, and this is not practical. Also, in order to avoid such complicated techniques as mentioned above, the conditions imposed on the insulating and protecting layer as those mentioned in Experiment (B) may be moderated, and the height of the barrier may be lowered to impart the insulating and protecting layer some degree of conductivity, and this technique will work all right only temporatily. In such a case, however, the ability of the layer to protect the surface of the a-Si film will deteriorate and the layer will not be able to stand the use for an extended period of time.

As discussed above, the problems encountered by the conventional photoreceptors have been found to lie in such matters as represented by the height of the barrier resulting from the difference between the forbidden band width of the photoreceptor and the forbidden band width of the surface protective layer, the sharp changes developed in the barrier, and the production of a space charge region caused by those carriers blocked and accumulated at the interface between the photoreceptive layer and the surface protective layer. Based on this finding, the present inventors have become aware that, by arranging so that the forbidden band width of the surface protective layer will change to become progressively greater as it goes from the interface toward the surface of the photoreceptor, the barrier located at the interface will decrease in its height, and at the same time the change will become gentler, and that, accordingly, the width of the space charge region becomes greater, so that the density of the accumulated charge can be lowered, and that, as a result, the conducting channel is not formed easily.

Figure 3:
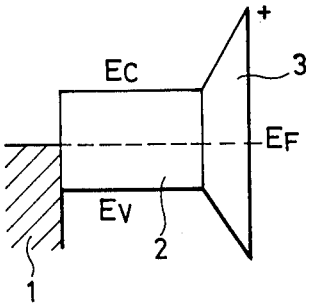
FIGS. 3 and 4 are illustrations showing the mutually different state of changes of the forbidden band widths of a-Si photoreceptors accroding to the present invention.
Figure 4:
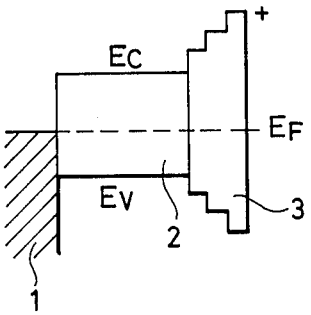
Figure 5:
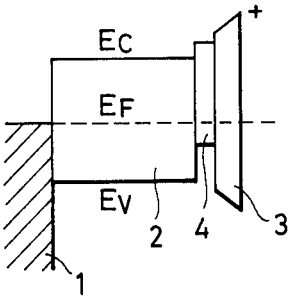
FIG. 5 is an illustration showing the energy band structure of an a-Si photoreceptor according to the present invention in case a p type layer is provided between the photoreceptive layer and the insulating and protecting layer.

Therefore, the present inventors tried to make the amorphous silicon nitride composition ratio Si/N so as to become gradually smaller as it goes from the interface toward the surface. The energy band structures of the photoreceptor relying on this method are shown in FIGS. 3 and 4. FIG. 3 shows the state that the forbidden band width of the surface protective layer increases continuously as it goes from the surface of the photoreceptive layer toward the surface of the photoreceptor. On the other hand, FIG. 4 shows the state that the width of the forbidden band increases stepwise. By so arranging, the composition of the amorphous silicon nitride film located in the vicinity of the surface of the photoreceptor closely approaches $Si_3N_4$, so that the aim of surface protection can be perfectly accomplished. Also, as shown in FIG. 5, it is also effective to provide further a p type-controlled layer 4 between the photoreceptive layer 2 and the insulating and protecting layer 3 to substantially avoid the formation of a space charge region and a conducting channel. In order to obtain the p type layer 4, it is only necessary to use such a substance as $B_2H_6$ gas as an impurity gas. It should be noted, however, that an intensive p type would cause the lowering of the surface resistance, which, in turn, would cause the degradation of the quality of the image. Thus, the p type layer need to have an appropriate resistivity and an appropriate thickness. As a result of the experiment, the thickness thereof is considered to lie in the range of 30~1000Å.

The result of this experiment performed according to the present invention is as follows. It should be understood that the method of forming an a-Si photoreceptive layer and the thickness of this layer are exactly the same as those conditions for Experiments (A) and (B). However, in this instant experiment, the formation of the amorphous silicon nitride film was performed under the conditions same as those for Experiment (B) in the beginning period of film formation, and by altering the conditions continuously as the film formation progressed to alter the composition until, finally, the conditions became equal to those for the Experiment (A), and thus the film was formed to have a thickness of 1500Å. The composition ratio Si/N of this silicon nitride was found to be shifting substantially continuously from 1.2 up to 0.8 as it goes toward the surface of the film.

The result of the copying test by using this photoreceptor thus obtained was that a clear image was obtained starting with the first sheet of copy, and no problem occurred for successive continuous copying operations. Also, in the intermittent endurance test conducted for an extended period of time, no problematical defective findings occurred at all until 100,000th copy. Thus, the photoreceptor of this experiment was completely satisfactory with respect also to prolonged service life.

As the result of various experiments, it was found that, by arranging the amorphous silicon nitride film to have a thickness within the range of 500~10000Å, and arranging its band gap to increase between 2.0~5.0eV, there is obtained an effect similar to that mentioned above.

As will be clear from the foregoing description, the photoreceptor according to the present invention is formed so that the forbidden band width of the surface protective layer increases gradually as it goes from the surface of the photoreceptive layer toward the surface of the photoreceptor. Accordingly, the photoreceptor of the present invention can sufficiently resist the use for an extended period of time, and moreover satisfactory copying can by achieved without being accompanied by deterioration of the quality of image. Also, the photoreceptive layer can be sufficiently stably protected by the surface protective layer, and thus prolongation of service life of the photoreceptor can be realized.

Description has been made centering around amorphous silicon nitride in the foregoing examples. It is needless to say that the present invention is equally effectively applied also to other types of insulating and protecting layers such as amorphous silicon oxide layer and amorphous silicon carbide layer.

What is claimed is:

1. An amorphous silicon photoreceptor for electrophotography, comprising:

a photoreceptive layer consisting essentially of amorphous silicon and having a forbidden band width value at an upper surface thereof; and a surface protective layer provided on said upper surface of the amorphous silicon photoreceptive layer and having an exposed outside surface, said surface protective layer having a forbidden band with whose value at the interface between the protective layer and the photoreceptive layer is similar to that of the photoreceptive layer and whose value substantially uniformly increases to a maximum value at the exposed outside surface of the protective layer, thereby facilitating passage of electrical charge carriers through the protective layer.

2. An amorphous silicon photoreceptor for electrophotogaphy according to claim 1, wherein:

said surface protective layer has a thickness in the range of 500 to 10000Å.

3. An amorphous silicon photoreceptor for electrophotography according to claim 1, wherein said surface protective layer is comprised of amorphous silicon nitride containing hydrogen, said surface protective layer having a composition ratio Si/N between the range of 0.75 to 1.2, said composition ratio being arranged to substantially uniformly decrease from said interface to the exposed outside surface of said surface protective layer.

4. An amorphous silicon photoreceptor fo electrophotography according to claim 3, wherein:

the thickness of said surface protective layer is in the range of 500 to 10000Å.

5. An amorphous silicon photoreceptor for electrophotography according to claim 3, further comprising:

a p type amorphous silicon layer having a thickness of 30 to 1000Å and provided between said amorphous silicon photoreceptive layer and said surface protective lyaer.

6. An amorphous silicon phtorecpetor for electrophotography according to claim 3, wherein:

said amorphous silicon photoreceptive layer is formed by relying on eh plasma CVD technique and by using $SiH_4$ gas, $N_2$ and $B_2H_6$ gas and possesses a resistivity of at least $10^{12}$/.cm in darkness.

7. An amorphous silicon photoreceptor for electrophotography according to claim 3, wherein:

said amorphous silicon photoreceptive layer is formed by relying on the plasma CVD technique and by using $SiH_4$ gas, $N_2$ gas, $B_2H_6$ gas and $PH_3$ gas, and possesses a resistivity of at least $10^{12}$.cm in darkness.

8. An amorphous silicon phtoreceptor for electrophotography as claimed in claim 3, wherein said surface protective layer has a composition close to $Si_3N_4$ at the exposed outside surface thereof.

9. An amorphous silicon photoreceptor for electrophotography as claimed in claim 3, wherein said composition ratio of Si/N varies substantially uniformly from 1.2 to 0.8 as it goes to said outside surface.

10. An amorphous silicon photoreceptor for electrophotography according to claim 1, wherein the value of the forbidden band width increases linearly.

11. An amorphous silicon photoreceptor for electrophtography according to claim 1, wherein the value of the forbidden band width increases substantially uniformly in a step-wise manner.

* * * * *